United States Patent [19]

Mosing

[11] 4,372,026

[45] Feb. 8, 1983

[54] METHOD AND APPARATUS FOR CONNECTING AND DISCONNECTING TUBULAR MEMBERS

[76] Inventor: Donald E. Mosing, P.O. Box 51729, Lafayette, La. 70505

[21] Appl. No.: 187,829

[22] Filed: Sep. 16, 1980

[51] Int. Cl.[3] ..... B25B 17/00

[52] U.S. Cl. ..... 29/426.5; 81/57.14; 81/57.18; 81/57.2; 81/59.1

[58] Field of Search ..... 81/53 A, 57.15, 57.18, 81/57.2, 57.33, 59.1, 57.11, 57.12, 57.13, 57.14; 294/86.29, 86.3; 279/1 H; 29/426.5

[56] References Cited

U.S. PATENT DOCUMENTS

| | | | |
|---|---|---|---|
| 1,412,688 | 4/1922 | Layton et al. | 81/59.1 |
| 1,811,666 | 6/1931 | Foster | 81/57.13 |
| 2,028,876 | 1/1936 | Lotts | 81/59.1 |
| 2,657,014 | 10/1953 | Webster | 81/57.15 |
| 2,834,239 | 5/1958 | Mancini | 81/59.1 |
| 3,621,739 | 11/1971 | Seablom | 81/59.1 |
| 3,698,266 | 10/1972 | Mader | 81/53 A |
| 4,060,014 | 11/1977 | Turner | 81/57.2 |

*Primary Examiner*—Lowell A. Larson

*Attorney, Agent, or Firm*—Guy E. Matthews

[57] ABSTRACT

A power energized mechanism for connecting and disconnecting pipe connections and the like comprising a housing structure having interconnected therewith a rotatable drive gear that is rotated by means of a suitable motor. A pair of spaced external ring gear elements are interconnected with the rotary drive gear with the external gear teeth thereof disposed in interengaging relation with opposed pinion gears provided on a plurality of cam elements that are positioned in spaced relation about the ring gears. Each of the cam elements incorporates an intermediate cam section having defined thereon a pair of cam surfaces that are adapted respectively to engage pipe that is positioned within the receptacle defined by the cooperating gear and cam mechanisms. To minimize deformation of the pipe during pipe rotating operations, the cam surfaces that engage the pipe define uniform motion curve cams that have the effect of self-tightening to ensure restriction of the magnitude of frictional engagement with the pipe to only that necessary for accomplishing rotation of the pipe.

15 Claims, 13 Drawing Figures

METHOD AND APPARATUS FOR CONNECTING AND DISCONNECTING TUBULAR MEMBERS

FIELD OF THE INVENTION

This invention relates generally to devices for making up and breaking out threaded tubular members and the like and, more particularly, to apparatus for accomplishing pipe connection and disconnection operations without causing interference, deformation or the like of the tubular members, which might otherwise detract from the strength, appearance or ability to safely use the tubular members.

BACKGROUND OF THE INVENTION

Apparatus for connecting and disconnecting and/or threading and unthreading tubular members such as pipe joints and the like is widely used. And, in particular, such apparatus is readily utilized in the drilling industry for the purpose of connecting and disconnecting sections of pipe and other elongated elements such as drill pipe, well casing, production tubing, sucker rods, etc., all herein generically referred to as pipe. During drilling, completion and servicing operations for deep wells such as are typically drilled for the production of petroleum products, lengths of pipe are interconnected by connecting operations for developing a string of pipe that is run into the well for the purposes intended. Further, upon removal of a string of pipe from the well it is necessary to break out the individual joints of pipe as the pipe string is withdrawn from the well. During making up and breaking out operations, it is desirable to provide power energized equipment that is capable of applying relatively high torque to the pipe joints, especially during breakout operations. In the petroleum industry, such power energized devices are typically referred to as power tong assemblies and these power tong assemblies have become quite well developed over the years.

In most cases, pipe tong devices incorporate teeth capable of biting into the outer surface of the pipe to establish a gripping relationship therewith. Such pipe engaging teeth are typically formed on inserts that are referred to as "dogs," and are driven into biting, pipe deforming relationship with a high degree of force. In many cases, the dogs of pipe tongs are driven by means of power energized cams and other mechanical force amplifying means to ensure the development of positive gripping relationship with the pipe in order to cause the pipe to rotate during application of high torque forces thereto.

It is well known that stress will materially weaken section of pipe under circumstances where the pipe is scored severely during handling operations such as thread makeup and breakout. Further, the forces applied by power tong devices can also cause substantial crushing of the pipe to occur and can result in stress fractures that materially detract from the functional capability of the pipe involved. It is desirable, therefore, to provide a power energized mechanism for makeup and breakout of threaded pipe connections having the capability of applying substantial torque to the pipe and yet which effectively prevents scoring or crushing of the pipe so that the inherent strength of the pipe remains substantially unchanged as the result of any makeup and breakout operations. Further, since pipe is frequently reused a number of times in the drilling, completion and servicing of wells, it is highly desirable to minimize any damage to the pipe that might be caused during thread makeup and breakout operations by the means of pipe tongs, thus providing for extended service life of the pipe.

SUMMARY OF THE INVENTION

It is a primary feature of the present invention to provide a novel power energized mechanism for making up and breaking out threaded pipe connections wherein pipe engaging drive devices are brought into rotating driving engagement with the pipe by being moved along a structure utilizing a curve such as uniform motion cam means of substantially uniform motion into frictional driving engagement with the pipe without penetrating, interference or deforming the outer surface of the pipe.

Other and further objects, advantages and features of this invention will become obvious to one skilled in the art upon an understanding of the illustrative embodiment about to be described and various advantages, not referred to herein, will occur to one skilled in the art upon employment of the invention in practice.

BRIEF DESCRIPTION OF THE DRAWINGS

In order that the manner in which the above-recited advantages and features of this invention are attained and can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of this invention, and therefore are not to be considered limiting of its scope, for the invention may admit to other equally effective embodiments.

IN THE DRAWINGS

Figure 1:
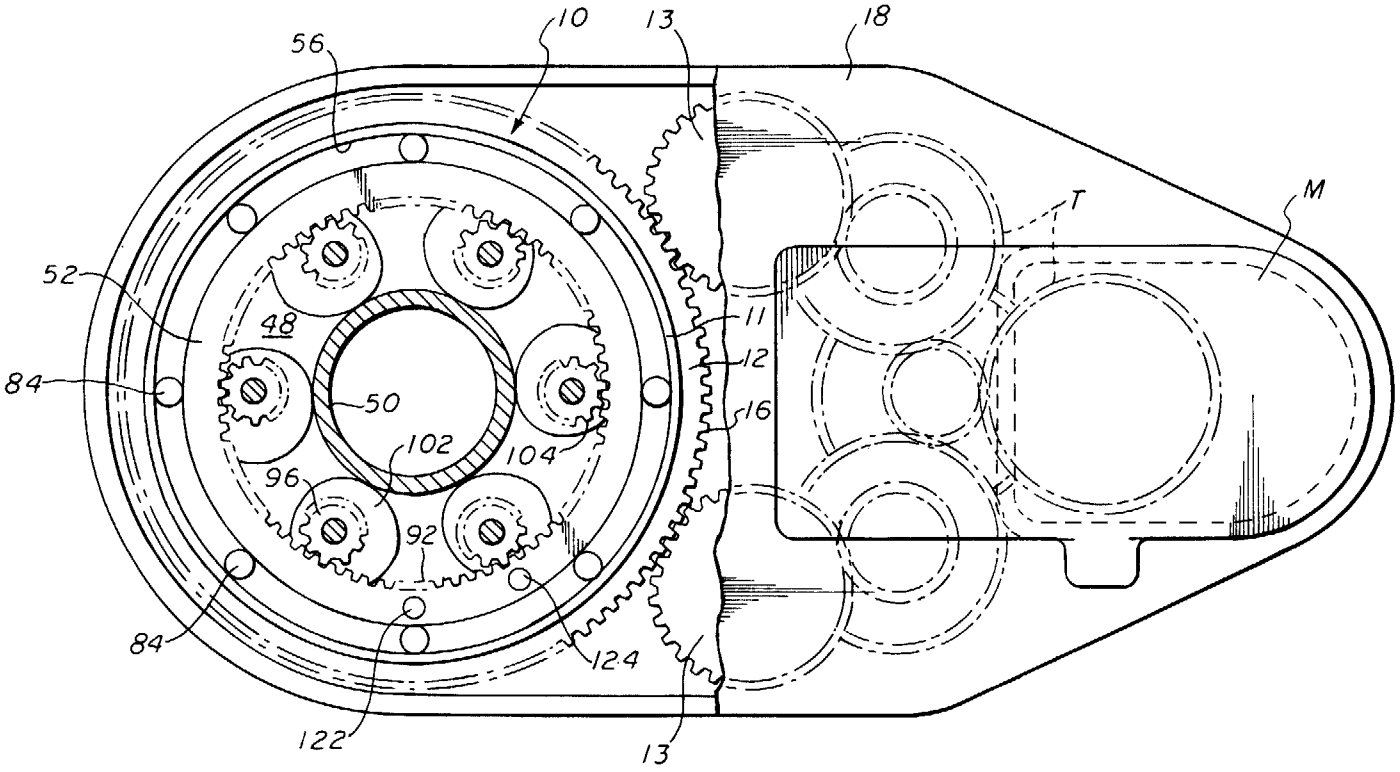

FIG. 1 is a plan view in section of a power energized pipe tong mechanism constructed in accordance with this invention and showing a plurality of uniform motion curve cams in the engaging positions thereof.

Figure 2:
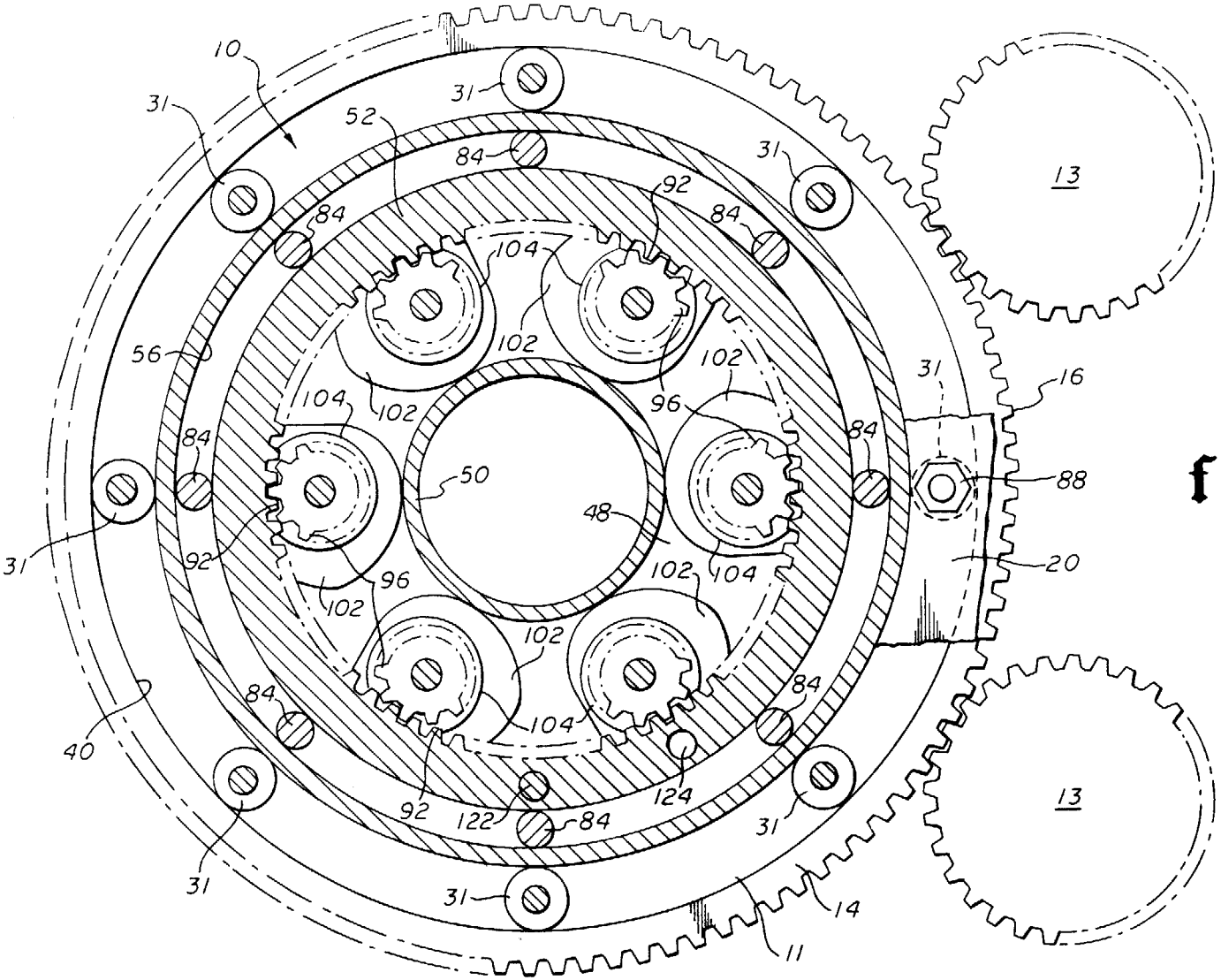

FIG. 2 is a partial sectional view in plan of the power energized pipe tong mechanism of FIG. 1 illustrating a plurality of uniform motion curve cams being disposed in engaging and completely encircling relation with pipe to be connected or disconnected.

Figure 3:
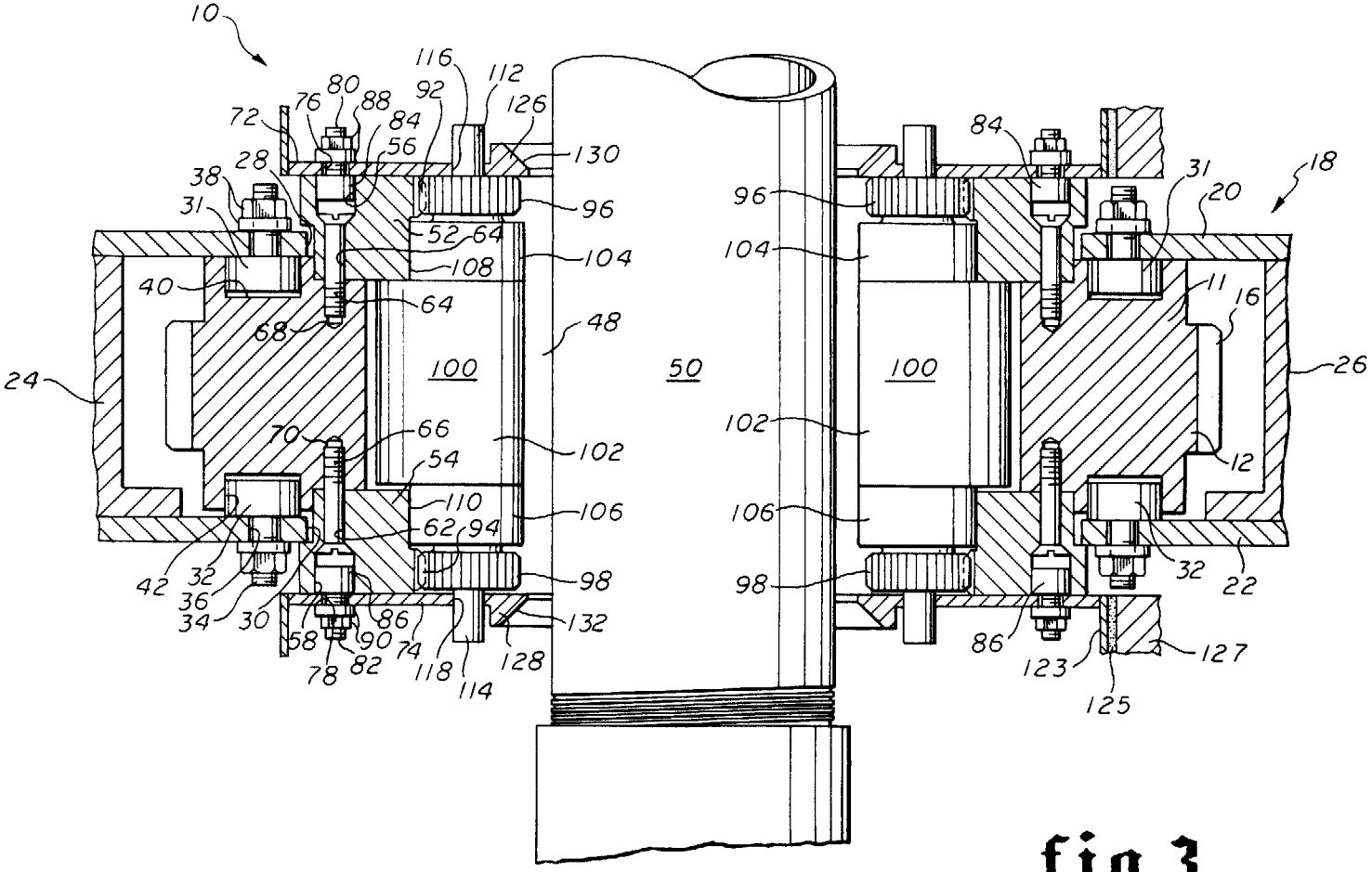

FIG. 3 is a partial sectional view of the apparatus of FIGS. 1 and 2, and illustrating the uniform motion curve cams in the retracted position thereof out of contact with the pipe.

Figure 4:
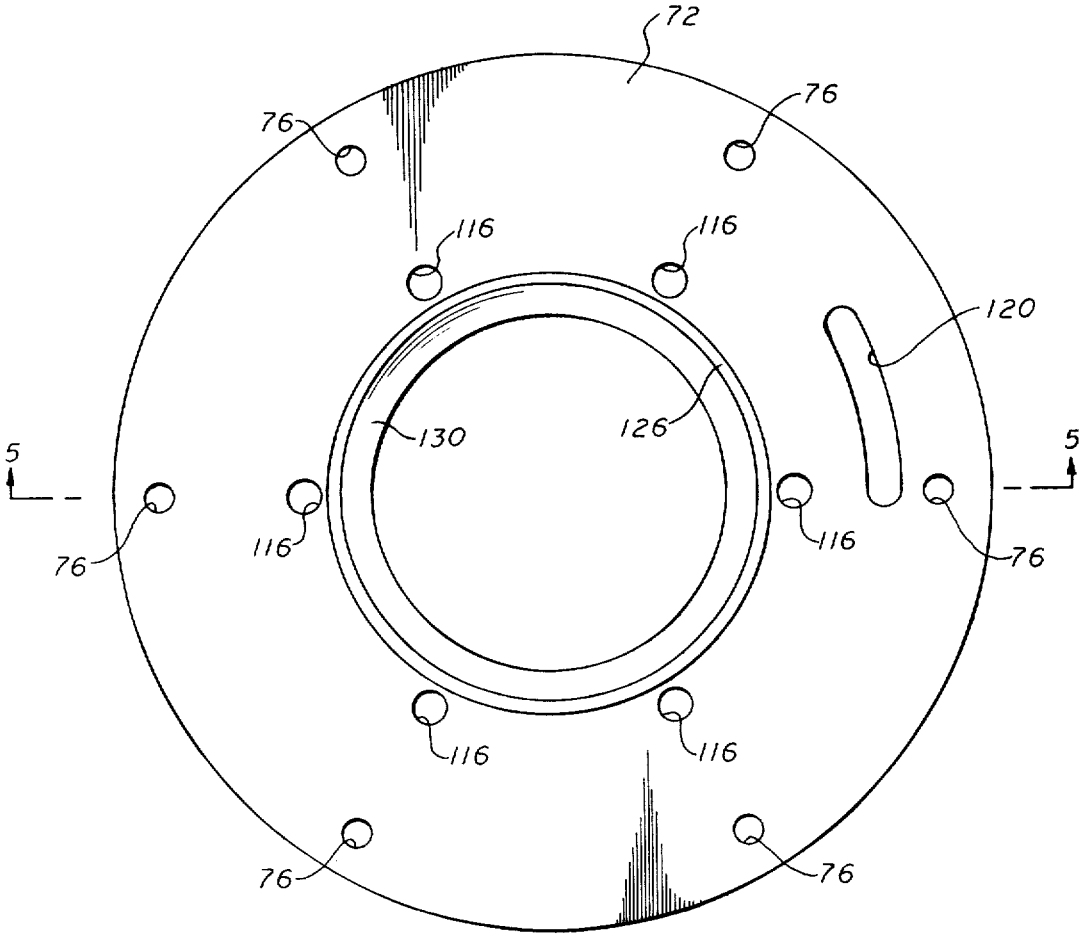

FIG. 4 is a plan view illustrating the upper retainer plate of the mechanism of FIG. 3 illustrating the structure of the retainer plates in detail.

Figure 5:
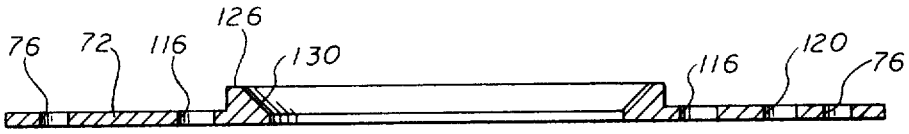

FIG. 5 is a sectional view taken along line 5—5 of FIG. 4 and further illustrating the detailed structure of the retainer plates.

Figure 6:
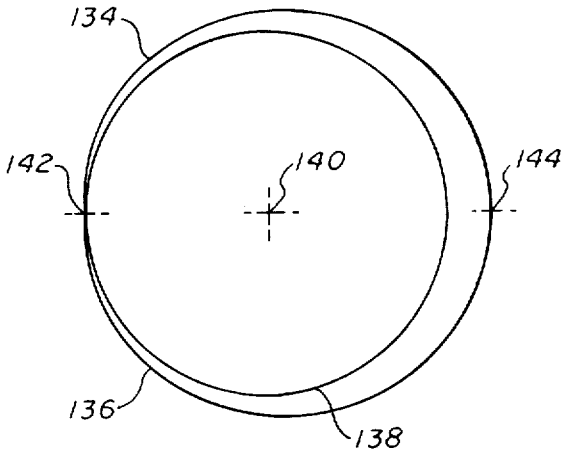

FIG. 6 is a graphical illustration showing a uniform motion cam defining a cam curve in accordance with the present invention.

Figure 7:
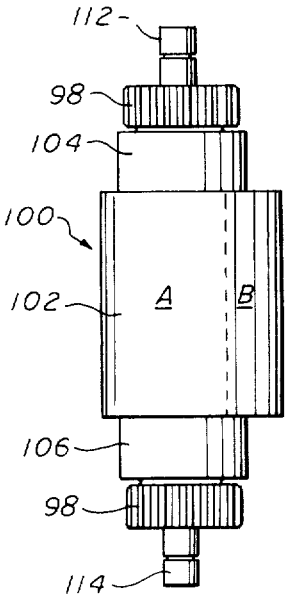

FIG. 7 is a side view of one of the uniform motion cam structures of FIGS. 2 and 3, illustrating the various components of the cam structure in detail.

Figure 8:
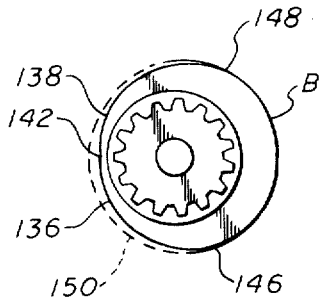

FIG. 8 is an end view of the cam structure of FIG. 7 illustrating opposed uniform motion cam surfaces being defined thereon.

Figure 9:
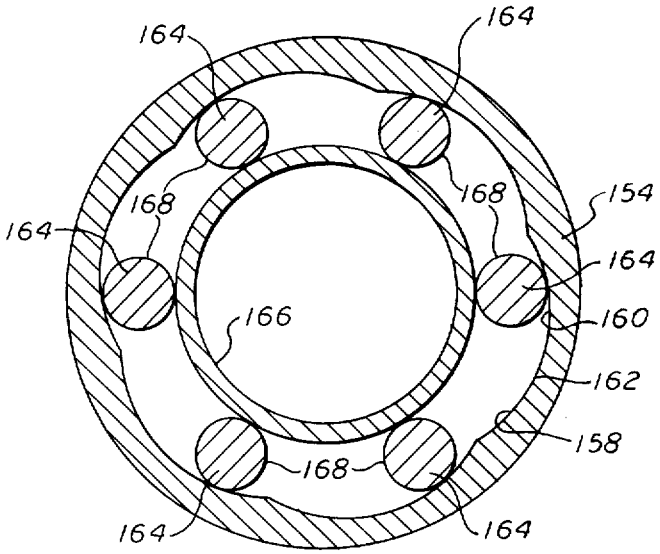

FIG. 9 is a partially graphical representation of an alternative embodiment of the present invention, illustrating pipe engaging roller elements that are driven by means of uniform motion cam curves defined on an encircling body structure.

Figure 10:
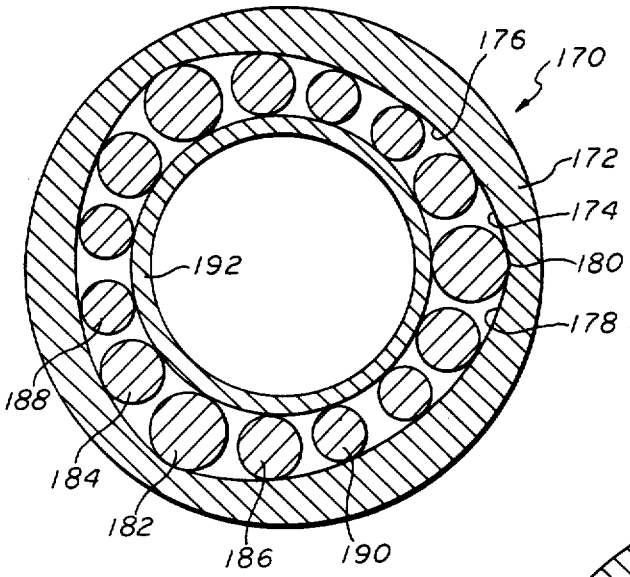

FIG. 10 is a view illustrating another alternative embodiment of the present invention wherein a plurality of rollers of differing size are energized by means of uniform motion cam curves, thus inducing the rollers to establish driving relationship with pipe to be connected or disconnected.

Figure 11:
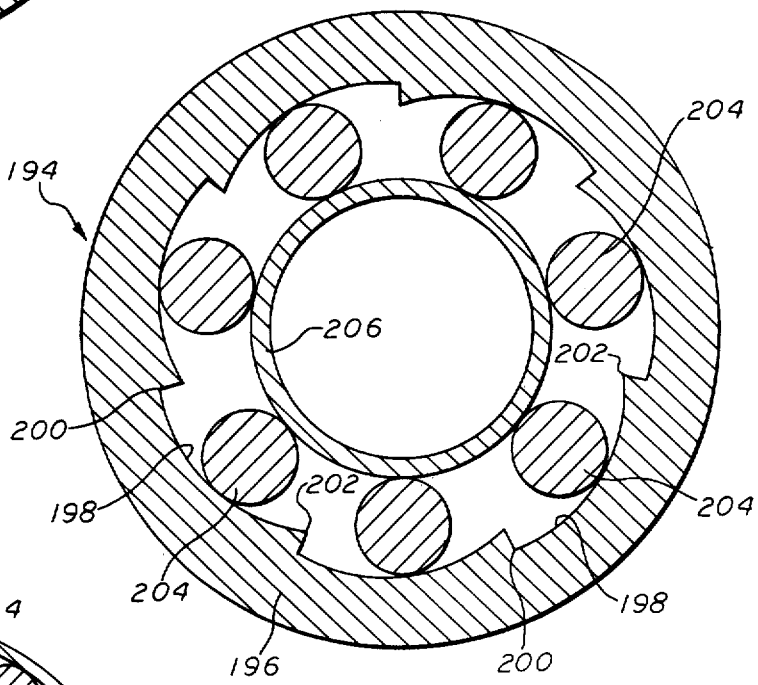

FIG. 11 is yet another embodiment of the present invention whereby a plurality of roller elements are energized by rotation of a housing structure in one direction wherein the housing structure incorporates a plurality of uniform motion cam curves that establish driving relation with the rollers.

Figure 12:
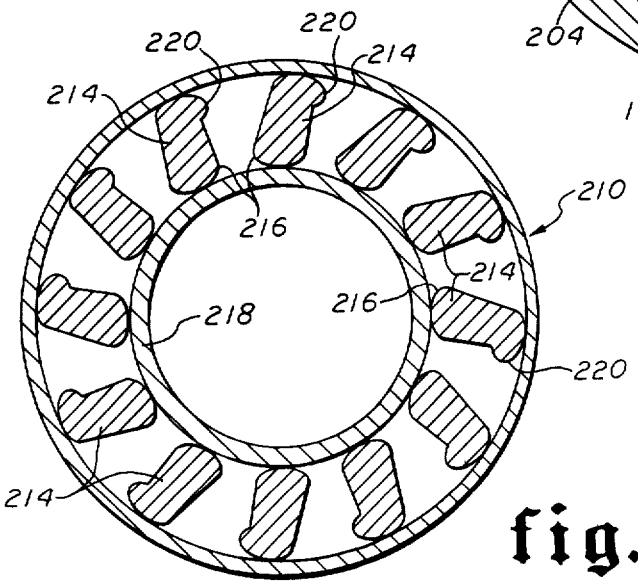

FIG. 12 is a pictorial representation in plan of a sprag type pipe connecting and disconnecting mechanism representing an alternative embodiment of this invention.

Figure 13:
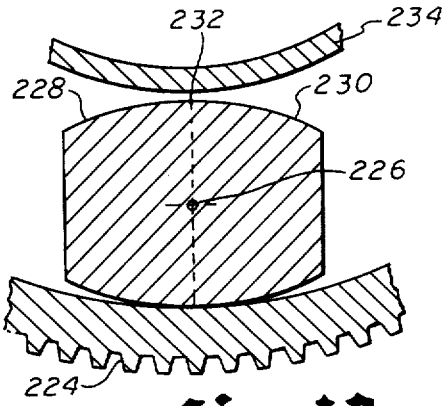

FIG. 13 is a pictorial representation of a yet further embodiment of this invention illustrating another friction engagement type pipe connecting and disconnecting mechanism constructed in accordance with the principles of this invention.

DETAILED DESCRIPTION OF THE PREFERRED EMBODIMENT

Referring now to the drawings for a more detailed understanding of this invention and with respect particularly to FIG. 1, there is illustrated a pipe connecting and disconnecting mechanism constructed in accordance with the present invention and referred to generally at 10. The pipe connecting and disconnecting mechanism incorporates a centrally disposed rotary drive gear 11 having an external gear ring 12 extending therefrom and defining external gear teeth 16. The gear teeth 12 are disposed in driven engagement with the mating teeth of drive gears 13 which form a part of a conventional power driven gear train T incorporating a drive motor M of any suitable type. The gear ring 12, if desired, may be formed integrally with the annular gear body 11 as shown, or, in the alternative, may be interconnected with the gear body in any suitable manner within the spirit and scope of this invention.

It is to be understood that FIGS. 1 and 2 illustrate a pipe connecting and disconnecting mechanism brought into position over the drilled hole and pipe or casing is extended through the central opening thereof; however the pipe tong structure of this invention may also take the form of a side opening type pipe tong system permitting transverse movement thereof into pipe engaging relation without departing from the spirit or scope hereof.

With reference particularly to FIG. 2, the drive gear 11 is rotatably positioned within a housing structure illustrated generally at 18, which housing structure incorporates upper and lower housing plates 20 and 22 together with one or more side wall members 24 and 26. The housing plates 20 and 22 may be of generally identical form with the interior portions thereof cut away and defining central openings 28 and 30.

A plurality of guide elements such as shown at 31 and 32 are interconnected with the housing plates 20 and 22 by threaded stud portions 34 that extend through apertures 36 which are defined in the respective housing plates. Nut and lock washer assemblies 38 are received by the threaded studs 34, thus securing the guide elements 30 and 32 in positive immovable assembly with respect to the housing plates. The drive gear 12 is formed to define upper and lower annular guide grooves 40 and 42 within which the plurality of guide elements 30 and 32 are received, thus providing a guiding and retaining function for the rotatable drive gear 12 as it rotates within the housing structure. A gear train incorporating gears 13 shown in FIG. 2, and which may conveniently take the form illustrated in FIG. 1, is disposed in driving relation with the gear teeth 16 of the drive gear 12 and is operative to impart reversible driving rotation to the drive gear. In the alternative, any other suitable gear drive mechanism capable of establishing mating relation with the gear teeth 16 of the drive gear may be utilized in lieu of the gear train typically illustrated in FIG. 1.

The housing structure and drive gear, together with other structure, define a central opening or receptacle 48 within which pipe 50 is received. It is desirable to establish a frictional relationship between the pipe and gripping mechanism without interfering, marking or scoring the pipe and to cause selective directional rotation of the pipe in order to accomplish connecting and disconnecting operations. It is also desirable to provide the pipe engaging mechanism with an efficiently controlled system having the capability of establishing optimum engaging relationship with the pipe and yet preventing the occurrence of pipe interference, scoring, deformation or crushing that might otherwise cause deformation, deterioration and weakening of the pipe, thereby rendering it possibly unsuitable for subsequent use. To provide these desired features, upper and lower ring gears 52 and 54 are formed, respectively, to define annular guide grooves 56 and 58 and bolt apertures 60 and 62 are formed through the ring gears and positioned within the respective guide grooves. A plurality of bolt elements 64 and 66 extend through the respective bolt apertures 60 and 62 and are received within threaded holes 68 and 70 that are formed in equally spaced relation about the upper and lower portions of the drive gear 11. Thus, the ring gears 52 and 54 are rotatable along with the drive gear.

A pair of upper and lower guide plates 72 and 74 are positioned for movement relative to the ring gears 52 and 54 and are formed to define a plurality of apertures 76 and 78 through which stud elements 80 and 82 extend for the purpose of interconnecting guide elements 84 and 86 in substantially immovable relation with respect to the respective guide plate. The guide elements 84 and 86 are received respectively within the guide grooves 56 and 58 and function to provide an interconnecting relationship with respect to the ring gears and guide plates and yet allow relative movement therebetween. Nut and lockwasher assemblies 88 and 90 are received by the respective stud elements 80 and 82 and secure the guide elements in positive immovable relation with the guide plates.

The inner peripheral portions of each of the ring gears 52 and 54 are formed to define internal gear teeth 92 and 94 that are received by opposed pinion gear portions 96 and 98 of a plurality of pipe engaging cam elements illustrated generally at 100. Each of the cam elements 100 is typically of integral form and incorporates a centrally disposed cam portion 102 having thrust bearing portions 104 and 106 defined thereon. The engaging surfaces defining the cam portions 102 are of smooth, tooth free configuration but, if desired, may be grooved or scored as desired to accomodate dirt, trash and other debris, thereby defining segmented smooth engaging surfaces. It should be understood, however, that such engaging surfaces defining the cam portion 102 do not grip, bite into, score the form or interfere with the exterior surface of the threaded tubular members, that because of their configuration and relationship to the motion curve means engages the threaded tubular members sufficiently for making up and breaking out of the tubular members relative to each other. The thrust bearing portions 104 and 106 are enabled to engage thrust surfaces 108 and 110 of the ring gears 52 and 54 so as to prevent excessive thrust loading of the gear teeth of the ring gears and pinion gears. At the opposed extremities of the cam elements 100 are formed pin or axle elements 112 and 114 that are received, respectively, within apertures 116 and 118 that are defined in the respective guide plates 72 and 74.

As shown in greater detail in FIGS. 4 and 5, the guide plates are formed to define an arcuate slot 120 that extends approximately 30° along an outer portion of the respective guide plate and adapted to mate with apertures 122 and 124 that are defined in the ring gears. The apertures 122 and 124 are formed about centers that are located substantially 30° apart thereby positioning the apertures for registry with the arcuate extremities of the slot 120. Depending upon the desired direction of rotational movement that accomplishes either connection or disconnection of the pipe a control pin will be extended through the arcuate slot 120 and will be received in selected ones of the apertures 122 and 124 depending upon the desired direction of rotation. Thus, the guide plates 72 and 74 are allowed to rotate approximately 30° in a direction that is selected by positioning of the control pin and this 30° rotational movement is sufficient to cause 180° rotation of the cam roller elements 100. The cam elements will be rotated to the maximum inwardly extended positions thereof upon the maximum allowable 30° rotation of the ring gears 52 and 54 relative to the guide plate in either selected direction. Obviously, such controlled relative rotation of the guide plates and ring gears is not intended to limit this invention in any manner whatever.

The pipe tong system hereof is provided with a drag brake system to accomplish desired rotational shifting of the guide plates relative to the ring gears to thus induce operative rotation of the cam elements 100. As shown in FIG. 3, a drag brake rim 123 is fixed in any suitable manner with the outer periphery of the guide plates. A drag brake band 125 is placed in operative juxtaposition with the drag brake rim and is controlled by any suitable brake operator means 127 to apply a frictionally induced retarding force to the drag brake rim. When such retarding force is thus applied by the drag brake system, the guide plates 72 and 74 are retarded and the gear drive mechanism of the ring gears and cam rollers induce operative movement of the cam rollers toward the driving or releasing positions thereof.

The control pin constitutes a part of a drag brake system in that it selects the direction of operation for connecting or disconnecting the pipe joints.

The inner peripheries of each of the guide plates 72 and 74 are provided with upward and downwardly directed rims 126 and 128 that define tapered guide surfaces 130 and 132 which have the function of guiding the pipe as it is inserted into the central opening or receptacle 48 defined by the apparatus.

As the guide plates 72 and 74 are moved relative to the respective ring gears 52 and 54, this relative movement causes rotation of the respective pinion gears 96 and 98 by virtue of the gear connection between the pinion gears and the internal gear teeth of the ring gears. When this occurs, the cam elements 100 are rotated, thus moving the cam portion 102 thereof into or out of engagement with respect to the pipe 50. As shown in FIG. 2, the cam portions 102 of the cam elements 100 are shown to be rotated into engaging relationship with the pipe 50 with the direction of rotation being such that the pipe 50 is unthreaded from the pipe joint of a lower pipe section during continuation of the direction of rotation illustrated by the arrow at the lower portion of the figure. Upon rotation in the opposite direction, the pinion gears 96 and 98 are driven in the opposite direction, thereby causing the opposite cam surfaces of the cam portions 102 to engage the pipe in such a manner that continued rotation will cause making up of the threaded connection between the pipe joints.

As mentioned above, it is highly desirable during pipe connecting and disconnecting operations to prevent interference of the pipe and it is also desirable that the pipe remain relatively unmarked during connecting and disconnecting operations in order that it may be efficiently reused a number of times or, in the event resale is desirable, the pipe will retain high resale value because of the unmarked condition thereof. This feature is efficiently accomplished in accordance with the present invention by providing cam elements having cam surfaces in which the slope of the surfaces is a uniform motion curve, and in which the slope of the curved surface at the point of contact with the tubular members varies in the range of from 0° to 20°. As illustrated in FIG. 6 a graphical representation of uniform motion curves 134 and 136 are defined about a circle 138 generated at a point 140. Each of the motion cam curves 134 and 136 are initiated at a point 142 along the circle 138 and may again intersect at point 144 after traversing 180° about the point of circle generation 140. Most desirably, however, the motion cam curves will extend only partially about the circle 138 and ordinarily that portion of the sloping curve structure that is not intended for engaging relationship with the pipe may be of ordinary eccentric curved form. As illustrated in FIG. 7, the letter A identifies that portion of the slope or curve which is the uniform motion curve portion defining the exterior surface of the cam designed and intended for engagement with the tubular members or pipe. Extending beyond the broken line as at B is the portion of the curve that is of ordinary eccentric form. Such feature is further clearly exemplified in FIG. 8 where an ordinary eccentric surface B is defined between points 146 and 148 while the exterior uniform motion sloping cam surfaces 136 and 138 are initiated and began at the point 142 and extend to points 146 and 148. As illustrated by the broken line 150, a continuation of the ordinary eccentric surfaces contracts with the motion curve surface of B. It is to be understood that the motion cam curve defines a constant angle that is within the angular range up from about 0° to 20° for engagement with the pipe with the constant angle of the slope or cam curve providing a continual increasing engagement with the pipe that causes the pipe or tubular member to become threaded or unthreaded and at the same time promotes a self-tightening capability that restricts the magnitude of frictional forces to the tubular member to thus prevent interference with the pipe while insuring rotation thereof.

The motion curve that is employed in the design of the cam surfaces cause radial forces to be exerted by the cam roller elements onto the surface of the pipe having a force magnitude that is in constant proportion with the magnitude of the torque developed. Thus, the forces that are applied by the cam elements to the pipe can be effectively controlled simply by controlling the magnitude of the torque that is applied to the pipe. This feature effectively allows frictional pipe gripping forces to be minimized, thus also minimizing pipe surface distortion, and yet promotes effective connecting or disconnecting of the pipe. This feature is possible because the cam angles of the various cam roller elements is constant and the radial forces therefore are dependent only on the magnitude of the torque which is because the relationship governing the torque capacity of the frictional surfaces of the device has as variables, the cam angle and the radial forces between the roller and the surface of the pipe. After the size of the cam roller elements has been established, the only variables are the cam angle and the radial force between the cam surfaces and the surface of the pipe. This leaves only the normal force to vary so the torque output is proportional to the radial force between the cam rollers and pipe. This is the advantage of employing the motion curve principle for the design of the cam surfaces. As mentioned above, the frictional cam surfaces are smoothly curved and do not define teeth that might otherwise cause damage to the outer surfaces of the pipe. The cam surfaces may be grooved, however, to accommodate dirt, pipe scale and other debris, thereby defining segmented frictional surfaces for engagement with the pipe.

Referring now to FIGS. 9–13, the present invention may take other convenient and alternative forms as shown. With reference particularly to FIG. 9, an alternative embodiment of the present invention is shown generally at 152 wherein a driven ring gear is shown at 154 having a plurality of cam curves 156 are defined therein. In each case, the cam curves 156 are defined by motion curve sections 158 and 160 that establish a smooth intersection at the midpoint therebetween as shown at 162. A plurality of cylindrical roller elements 164 are positioned relative to the cam curves 156 such that when the rollers are positioned at or near the midpoint of each of the cam curves, the rollers are out of contact with the pipe 166. Upon rotation of the gear-driven ring 154 in either direction, the curve sections 158 and 160 cause movement of the outer peripheral surface 168 of the respective rollers into gripping relation with the pipe 166, thus causing threaded makeup or breakout of the pipe joint depending upon the selected direction of rotation.

An embodiment similar to that of FIG. 9 is illustrated in FIG. 10 wherein pipe connecting and disconnecting apparatus, illustrated generally at 170, employs a driven ring gear 172 which, in this case, employs three internal cam curves 174, each having opposed uniform motion curve sections 176 and 178 generated about a midpoint 180 of each of the cam curves. Three sets of five pipe engaging rollers are shown with each set being represented by a large central roller 182 having intermediate sized rollers 184 and 186 on either side thereof and with yet smaller rollers 188 and 190 defining the outer rollers of each set. Each of the rollers is adapted to contact respective ones of the cam curve sections 174 and 176 depending upon the direction of rotation and with the larger roller 182 adapted to traverse the midpoint 180 and be moved into operative relation with either of the cam curves. By employing only three sets of cam curves in this manner, the uniform motion curves may be of very general nature and may be effectively responsive to cam movement, thus requiring only minimal relative rotation of the ring gear to cause movement of the drive roller elements into gripping relation with the pipe 192. Moreover, the general nature of the uniform motion curves illustrated in FIG. 10 renders the pipe connecting and disconnecting apparatus to a condition for move efficient control. Further, the large number of drive rollers employed in the threading and unthreading apparatus of FIG. 9 effectively increase the surface area contact between the rollers and the outer peripheral surface of the pipe, thereby further enhancing the control capability of connecting and disconnecting operations.

Another making up and/or breaking out mechanism is illustrated generally at 194 in FIG. 11 where a ring gear structure 196 which is driven in any suitable manner incorporates a plurality of uniform motion curve cam segments 198, each extending in the same direction from low points such as shown at 200 to high points 202. A plurality of roller elements 204 of cylindrical form are positioned between the respective cam curves and the pipe 206. When the rollers are disposed near the low points of the cam curves, the rollers are out of contact with the pipe and pipe may be inserted to or removed from the central opening or receptacle defined by the apparatus. When the rollers 204 are moved toward the high points 202, the uniform motion curve cams 198 induce movement of the rollers into contacting relation with the outer surface of the pipe to cause making up and/or breaking out operations. It should be borne in mind that two oppositely directed ring elements can be employed with one being utilized for thread disconnecting operations and the other being utilized for thread connection operations. Each of the two ring elements incorporate oppositely directed cam curves and are selectively energized, depending upon whether pipe coupling or uncoupling operations are desired.

It may be desirable to employ a sprag principle within the scope of the present invention to provide a mechanism for threading and unthreading pipe sections. Accordingly, FIG. 12 illustrates a sprag-type pipe threading and/or unthreading and/or making up and/or breaking out mechanism generally at 210 which incorporates a suitable rotary gear structure (not shown) that is adapted to induce pivoting motion to a plurality of sprag elements 214. The sprag elements are formed to define pipe engaging cam surfaces 216 that are adapted for engagement with pipe 218 in order to achieve directionally controlled rotation thereof for threading and unthreading pipe sections. Each of the sprag elements is formed to define control surfaces 220 that are formed in accordance with the uniform motion curve cam principle discussed above. The control surfaces 220 engage the rotatable gear and induce rotation to the sprag elements causing the curved pipe engaging surfaces 216 thereof to be moved into pipe engaging, driving relation. When employing pipe connecting and disconnecting mechanisms of the sprag-type, it is necessary to provide upper and lower sprag energized pipe engaging devices which are selectively rotated in the direction of either pipe threading or pipe unthreading, as the case may be. In other words, if the pipe is to be connected, one of the sprag mechanisms is rotated while, if the pipe is to be disconnected, the other of the sprag mechanisms becomes operative.

The principles of this invention may take another suitable form as indicated in FIG. 13 wherein a plurality of cam elements are employed as shown at 222 which are pivotally or rotatably supported relative to a rotary gear structure 224. The cam elements are pivotal about an axis 226 and define pipe engaging drive surfaces 228 and 230 on either side of a mid-point on line 222. The thickness of the cam elements is less than the distance between the pipe 234 and the drive gear 224 and thus with the cam rollers positions as shown in FIG. 13, the cam elements will be out of driving engagement with the pipe. Upon rotation of the cam elements in either direction about the axes 226 thereof, the pipe engaging cam surfaces 228 or 230 will be selectively moved to the pipe engaging position thereof, depending upon the direction of rotation of drive gear 224 to cause making up or breaking out of the pipe joints.

In view of the foregoing, it is clear that the present invention results in threading and unthreading apparatus that overcomes the above-noted objections and is therefore well adapted to attain all of the objects and advantages hereinabove set forth, together with other advantages which will become obvious and inherent from a description of the apparatus utilized in accordance with the teachings of this invention. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A power energized mechanism for making up and breaking out sections of tubular members and the like said mechanism comprising:

a housing structure;

drive means supported by said housing;

power means for imparting power to said drive means; and means for engaging said tubular members, said means for engaging being positionable into and out of engagement with the tubular members by said drive means, said means for engaging the tubular members upon actuation of said drive means including curved surfaces thereon defining a uniform motion curve wherein making up or breaking out of said tubular members occurs upon movement of the drive means and said curved surfaces cause engagement and rotation of the tubular members for such making up and breaking out operations as desired without interfering with the surface of the tubular members.

2. The structure as set forth in claim 1 wherein said means for engaging the tubular member includes a plurality of cams rotatable responsive to the drive means, and said curved surfaces define the exterior surfaces of said cams, and wherein rotation of said drive means causes said cams to move into and out of engagement with the tubular member and enables the curved surfaces of each of said cams to cause force to be exerted by said cams on the surface of the tubular member without damaging the tubular member and yet with a sufficient force to rotate the tubular member for making up and breaking out the tubular member as desired.

3. The structure as set forth in claim 1 wherein the curved surface of said means for engaging defines a constant angle within the range of from 0° to 20°.

4. The structure as set forth in claim 1 wherein said means for moving includes:

(a) a ring mounted adjacent to and adapted to be rotated by said drive means;

(b) wherein said curved surfaces define the interior surface of said ring forming a plurality of uniform motion curved surfaces; and (c) a plurality of rollers mounted adjacent said curved surfaces wherein rotation of said ring in the desired direction causes each of said rollers to move along said respective curved surfaces to move into or out of engagement with the tubular member for making up or breaking out such tubular member.

5. The structure as set forth in claim 1 wherein said means for moving includes:

(a) a ring mounted adjacent to and adapted to be rotated by said drive means; said ring including an interior surface thereof;

(b) a plurality of rollers disposed between the ring and the tubular member each of such rollers having an exterior surface defined by said curved surfaces wherein rotation of said ring causes the surface of the rollers to move into and out of frictional engagement with the tubular member to enable making up or breaking out of the tubular member as desired without interfering, scoring or marking such tubular members.

6. The structure as set forth in claim 1 wherein said means for moving includes:

(a) a ring gear mounted adjacent to and adapted to be rotated by said drive means;

(b) wherein said curved surfaces define the interior surface of said ring gear forming a plurality of uniform motion curve curved surfaces; and (c) a plurality of rollers mounted adjacent each of said curved wherein rotation of said ring in the desired direction causes each of said plurality of rollers to move along said respective curved surfaces to move into or out of engagement with the tubular member for making up or breaking out such tubular member or desired.

7. The structure as set forth in claim 6 wherein each of said plurality of rollers mounted adjacent each of said curved surfaces has a different size radius.

8. The structure as set forth in claim 5, wherein at least one of said rollers has a different size radius than the other of said rollers.

9. The structure as set forth in claim 1 wherein said means for engaging includes:

(a) a ring mounted adjacent and adapted to be rotatably said drive means;

(b) said ring having an interior surface; and (c) a plurality of rollers, said curved surfaces defining the exterior surface of each of said plurality of rollers rollers being mounted adjacent the interior surface of the ring wherein rotation of said ring rotates the rollers into engagement with the tubular member and enables said tubular member to be made up or broken out, depending on the position of said ring gear.

10. The structure as set forth in claim 1 wherein said means for engaging includes:

(a) ring gear means mounted adjacent said drive means;

(b) a plurality of roller elements mounted between said ring gear and the tubular members;

(c) each of said roller elements being defined by a motion curve surface end section, a connection section and a pipe engaging section wherein rotation of said elements causes said motion curve section to move into and out of engagement with said ring gear and thus moves said pipe engaging section into and out of frictional engagement with the tubular member as desired.

11. The structure as set forth in claim 1 wherein said means for engaging includes:

(a) a ring gear mounted adjacent and adapted to be turned by said drive means;

(b) the interior surface of said ring gear defined by a plurality of said curved surfaces; and (c) a plurality of roller elements, each of said roller elements being defined by an exterior motion curve surface with at least one of said roller elements having a different size radius from the other of said roller elements wherein rotation of said roller elements causing said motion curve sections to move into and out of engagement with said ring gear and tubular member respectively, as desired.

12. A method for making up and breaking out threaded pipe joints through the use of power energized mechanical apparatus, said method comprising:

(a) restraining a first section of pipe against rotational movement;

(b) mounting a plurality of pipe engaging elements adjacent a second section of pipe; including means for moving said pipe engaging elements toward said second section of pipe in uniform motion relative to movement of said means moving about the axis of the second section of pipe;

(c) moving said elements into engagement with a second pipe section and enabling the motion curve section to engage the pipe for rotation as desired; and (d) moving said pipe engaging elements about the axis of the second pipe while in engagement with the second pipe section thus causing selective making up and breaking out of the threaded connection of the first and second pipe sections.

13. A method as recited in claim 12, wherein the uniform motion is in response to a uniform motion curve defining a constant angle in the range of from 0° to 20°.

14. A method for making up and breaking out threaded pipe joints by the use of power energized mechanical apparatus said method comprising the steps of:

(a) restraining a first section of pipe against rotation movement;

(b) providing a ring gear having a plurality of uniform motion curve surfaces formed along the interior surface thereof;

(c) mounting a plurality of pipe engaging elements between the ring gear and a second section of pipe;

(d) moving said pipe engaging elements into engagement with the ring gear which causes the elements to frictionally engage the second pipe section for making up and breaking out threaded connection between the first and second pipe section as desired.

15. The method as set forth in claim 14, including mounting a ring gear means adjacent the pipe engaging elements wherein the ring gear means only includes a plurality of motion curve surfaces extending in one direction and wherein movement of the pipe engaging elements only enables the first and second pipe sections to be threaded or unthreaded, but not both.

* * * * *